US007243377B2

(12) United States Patent
Ashy

(10) Patent No.: US 7,243,377 B2
(45) Date of Patent: Jul. 17, 2007

(54) HAT WITH INTERCHANGABLE ADVERTISING MEDIA

(76) Inventor: Michael Ashy, 1622 Forest Trace Dr., Sugar Land, TX (US) 77479

( * ) Notice: Subject to any disclaimer, the term of this patent is extended or adjusted under 35 U.S.C. 154(b) by 0 days.

(21) Appl. No.: 11/199,312

(22) Filed: Aug. 8, 2005

(65) Prior Publication Data

US 2007/0028361 A1 Feb. 8, 2007

(51) Int. Cl.
*A42B 1/24* (2006.01)

(52) U.S. Cl. ..... 2/209.13; 40/329

(58) Field of Classification Search ..... 2/209.13; 40/329

See application file for complete search history.

(56) References Cited

U.S. PATENT DOCUMENTS 5,359,734 A * 11/1994 Rathburn ..... 2/195.1
5,740,557 A * 4/1998 Reid et al. ..... 2/209.13
6,175,963 B1 * 1/2001 Loeffelholz ..... 2/209.13
6,519,779 B1 * 2/2003 Taguchi ..... 2/209.12
6,675,512 B1 * 1/2004 Shwartz et al. ..... 40/329
6,718,559 B1 * 4/2004 Davidson ..... 2/422

* cited by examiner

*Primary Examiner*—Katherine M. Moran
(74) *Attorney, Agent, or Firm*—N. Alexander Nolte

(57) ABSTRACT

Embodiments of the invention generally provide a wearable hat that contains an interchangeable advertising media location positioned on an exterior portion thereof. The interchangeable advertising media location is generally configured to receive an advertising media logo that may be quickly and easily removed and replaced with a different advertising media logo. The respective advertising media logos may be removable secured to the advertising media location via magnetic securing means, Velcro®, or other means of removably securing an advertising object to an article of clothing.

13 Claims, 2 Drawing Sheets

HAT WITH INTERCHANGABLE ADVERTISING MEDIA

BACKGROUND OF THE INVENTION

1. Field of the Invention

Embodiments of the invention generally relate to a hat that contains interchangeable advertising media attached thereto.

2. Description of the Related Art

The present invention relates to a hat or other piece of clothing worn on the head that has an interchangeable advertising media device positioned thereon. The invention has particular applicability to advertising in sporting events such as golf, baseball, basketball, auto racing, football, soccer, etc. It is to be noted, however, that although the present invention is described below with respect to a ball cap-type hat in general, the invention is not intended to be limited to any particular hat or type of headgear. Rather, the present invention is contemplated as being applicable to all types and sizes of hats and headgear worn by humans and/or animals.

The popularity of sporting events in the United States and around the world has grown at an unprecedented pace in the past 10 years. Further, the popularity of sporting events shows few signs of slowing down in the upcoming 10 years. Given societies almost unexplainable interest in sporting events, Corporate America has essentially no choice but to support sporting events. Corporate America's support of sporting events generally occurs through purchasing advertising at the particular sporting event, or alternatively, through purchasing advertising on one of the mass media service providers that are covering the sporting event, such as radio, television, Internet broadcasts, etc.

In sports such as golf, football, auto racing, basketball, etc. one of the more popular forms of advertising that Corporate America purchases is what is called "logo advertising." Logo advertising generally consists of positioning a corporate logo on an article of clothing that is worn by the event participants.

Although sporting teams derive substantial revenue from logo advertising, the advertising dollar generated by logo advertising is limited by the physical space available for advertising media to be placed. As such, it would be desirable for sporting teams to be able to increase their logo advertising revenue without increasing the finite amount of logo advertising space that is available on the sporting teams clothing.

SUMMARY OF THE INVENTION

Embodiments of the invention generally provide a wearable hat. The hat includes a hat body configured to receive a head of a wearer, a brim attached to the hat body and extending therefrom, the brim being positioned on the body at a position above the face of the wearer, and an advertising media location positioned on the hat body. The hat further includes a releasable advertising logo positioned in the advertising media location, a first magnetic material positioned in the advertising media location, and a second magnetic material positioned in the advertising logo, the first and second magnetic material generating an attractive force therebetween.

Embodiments of the invention generally provide an article of clothing that contains an interchangeable advertising media location. The interchangeable advertising media location is generally configured to receive an advertising media logo that may be removed and replaced with a different advertising media logo in a matter of seconds. The respective advertising media logos may be removable secured to the advertising media location via magnetic securing means, for example.

Embodiments of the invention may further provide a wearable hat that contains at least one interchangeable advertising media location positioned on an exterior portion of the hat. The interchangeable advertising media location is generally configured to receive an advertising media logo that may be quickly and easily removed and replaced with a different advertising media logo. The respective advertising media logos may be removably secured to the advertising media location via magnetic securing means, Velcro®, or other means of removably securing an advertising object to an article of clothing, for example. The logo of the present invention is releasably secured to the advertising media location so that one logo may be replaced with another logo in a matter of seconds.

Embodiments of the invention may further provide a hat with interchangeable advertising media, wherein the hat includes a hat body, an advertising media receiving location positioned on the hat body, a logo sized to be received in the advertising media location, and means for releasably securing the logo to the advertising media location.

BRIEF DESCRIPTION OF THE DRAWINGS

So that the manner in which the above recited features of the present invention are attained can be understood in detail, a more particular description of the invention, briefly summarized above, may be had by reference to the embodiments thereof, which are illustrated in the appended drawings. It is to be noted, however, that the appended drawings illustrate only typical embodiments of this invention, and are therefore, not to be considered limiting of its scope, for the invention may admit to other equally effective embodiments not specifically illustrated or discussed herein.

DETAILED DESCRIPTION OF THE PREFERRED EMBODIMENT

Embodiments of the invention generally provide a wearable hat that contains at least one interchangeable advertising media location positioned on an exterior portion of the hat. Each of the interchangeable advertising media locations are generally configured to receive an advertising media logo that may be quickly and easily removed and replaced with a different advertising media logo, without even removing the hat from the wearer if desired. The respective advertising media logos may be removably secured to the advertising media location via magnetic securing means, Velcro®, or other means of removably securing an advertising object to an article of clothing, for example. The logo of the present invention is releasably secured to the advertising media location, which generally means that the logo is not sewn to the hat. Rather, the logo is releasably secured so that one logo may be replaced with another logo in a matter of seconds.

Figure 1:
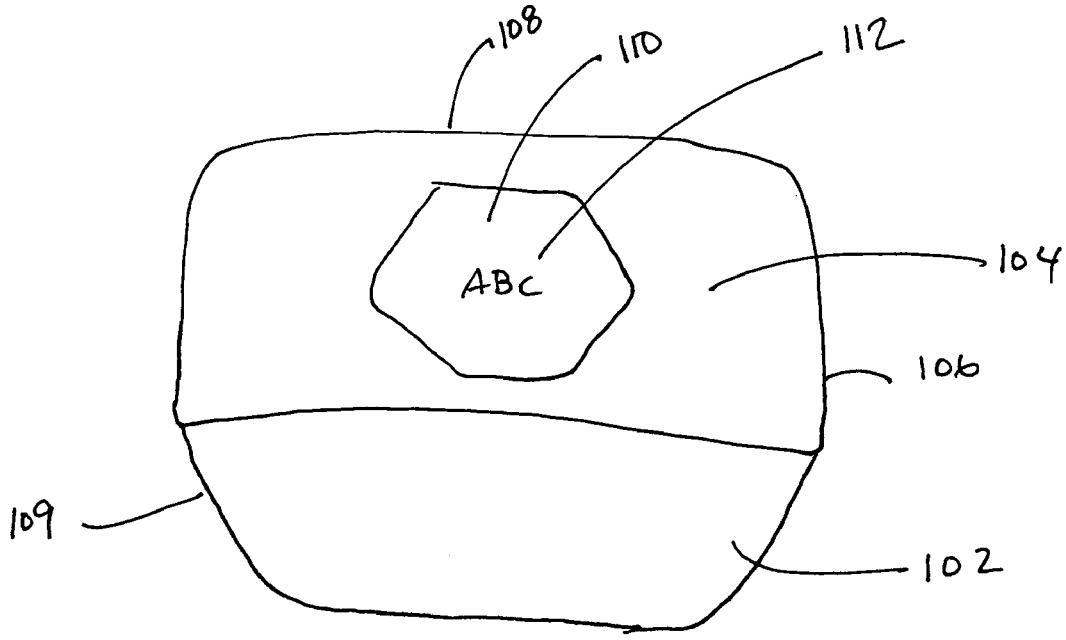
FIG. 1 illustrates a front perspective view of an exemplary hat of the invention.

FIG. 1 illustrates a front perspective view of an exemplary hat of the invention containing the interchangeable advertising media locations. Hat 100 may be any type of hat or headgear that is typically worn by sporting event participants, coaches, officials, or spectators. Hat 100, for example, may be a baseball-type hat, a golf or fishing-type hat that has a brim that extends completely around the periphery of the hat, a Scottish-type hat having a somewhat flat top portion and a small brim that extends outward over the face of the wearer, or any other type of hat that may benefit from having the interchangeable advertising media locations positioned thereon. Inasmuch as the hat of the invention may be any sort of headgear that is able to receive the interchangeable advertising media locations, hat 100 may be a soft fabric-type headgear, which are typically called "dew rags," that does not contain any type of brim. These types of headgear typically comprise a fabric sheet that is stretched over the top of the head of the user and tied or otherwise secured in the back to keep the fabric sheet tight against the head of the wearer.

The exemplary hat 100 of the invention shown in FIG. 1 generally includes a baseball-type hat 100 that has a body 104 configured to fit over the head of the wearer and a brim 102. The body 104 is generally conical in shape, and as such, has a generally annular side wall portion 106 and a top portion 108 that cooperatively form a receptacle having an opening 109 configured to fit over the head of the wearer of the hat 100. The body 104 is generally manufactured from a semi-rigid fabric that forms freely upstanding side walls 106. The top portion 108 is generally integrally formed with the side wall 106 and is also manufactured from a semi rigid fabric material. The brim 102 generally extends longitudinally outward from the hat body 104, and more particularly, the brim 102 generally extends outward from the body 104 in a position above the face of the wearer of hat 100.

Regardless of the type of hat 100 used in the various embodiments of the invention, the hat or headgear of present invention generally includes an interchangeable advertising media location 110, also referred to herein as a receiving element, on an exterior surface of the body 104 of hat 100. The interchangeable advertising media location 110 is generally configured to interchangeably receive and secure an advertising logo 112 thereto. The interchangeable advertising media location 110 generally receives one advertising logo 112 at a time, however, the invention is not intended to be limited to an embodiment where a single logo 112 is received at a time, as alternative embodiments of the invention may allow for receipt of more than one logo 112 at a time. Further, embodiments of the invention are not limited to a single advertising media location 110 being positioned on a hat 100, as the inventor contemplates that multiple advertising media locations 110 may be positioned on various locations or surfaces of the body 104, brim 102, or other surfaces of portions of the hat 100.

Figure 2:
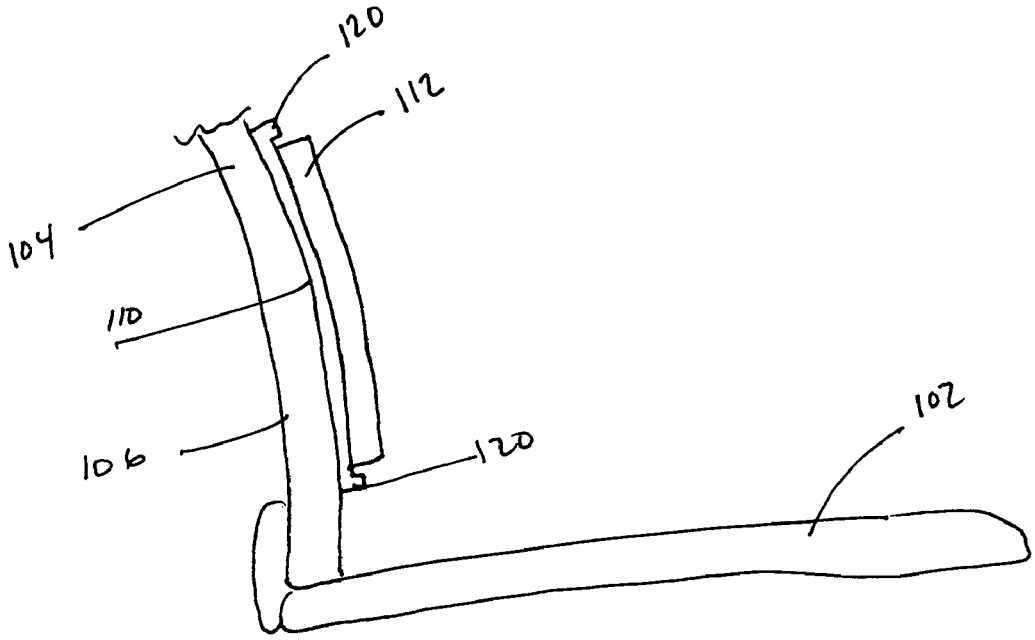
FIG. 2 illustrates a close up sectional view of an exemplary advertising media location of the invention.

FIG. 2 illustrates a close up sectional view of an exemplary advertising media location 110 of the invention. FIG. 2 illustrates that the advertising media location 110 may be positioned on the upstanding side wall portion 106 of the body 104. However, it is to be noted that embodiments of the invention are not limited to positioning the advertising media location 110 on any particular portion of the hat 100, as it is contemplated that the advertising medial location 110 may be positioned on any surface of hat 100. FIG. 2 further illustrates the logo 112 as a separate article from the side wall 106 and the advertising media location 110 of hat 100. More particularly, the advertising media location 110 generally includes a means for securing the logo 112 to the advertising medial location 110. The means for securing may be magnetic, Velcro®, or other means of releasably or detachably securing logo 112 to the advertising media location 110.

In embodiments of the invention, detachably securing is generally defined as the process of being able to secure the logo 112 to the advertising media location 110 in a manner that maintains the logo 112 on the advertising media location 110 and allows for display of the logo 112. Additionally, detachably securing is further defined as allowing the logo 112 to be removed from the advertising media location 110 without damaging the logo 112, and further, the process of removing the logo 112 from the advertising media location 110 may generally be accomplished in less than about 3 seconds and without any tools. Once a logo 112 is removed from the advertising media location 110, a second and different logo 112 may be secured to the advertising media location. In similar fashion to the removal process, the process of securing the second logo 112 to the advertising media location may generally be accomplished in less than about 3 seconds and may be accomplished without any tools. In some embodiments of the invention, the process of removing or securing the logo 112 may be accomplished in less than about 1 second.

The sectional view of FIG. 2 also illustrates that the advertising media location 110 may include a guide member 120. The guide member 120 generally comprises a protruding member that extends outward from the advertising media location 110. The guide member 120 generally operates to center the logo 110 in the advertising media location. The guide member 120 may completely circumscribe the advertising media location 110, or alternatively, the guide member 120 may comprise a plurality of individual guide members 120 positioned around the perimeter of the advertising media location 110.

Figure 3:
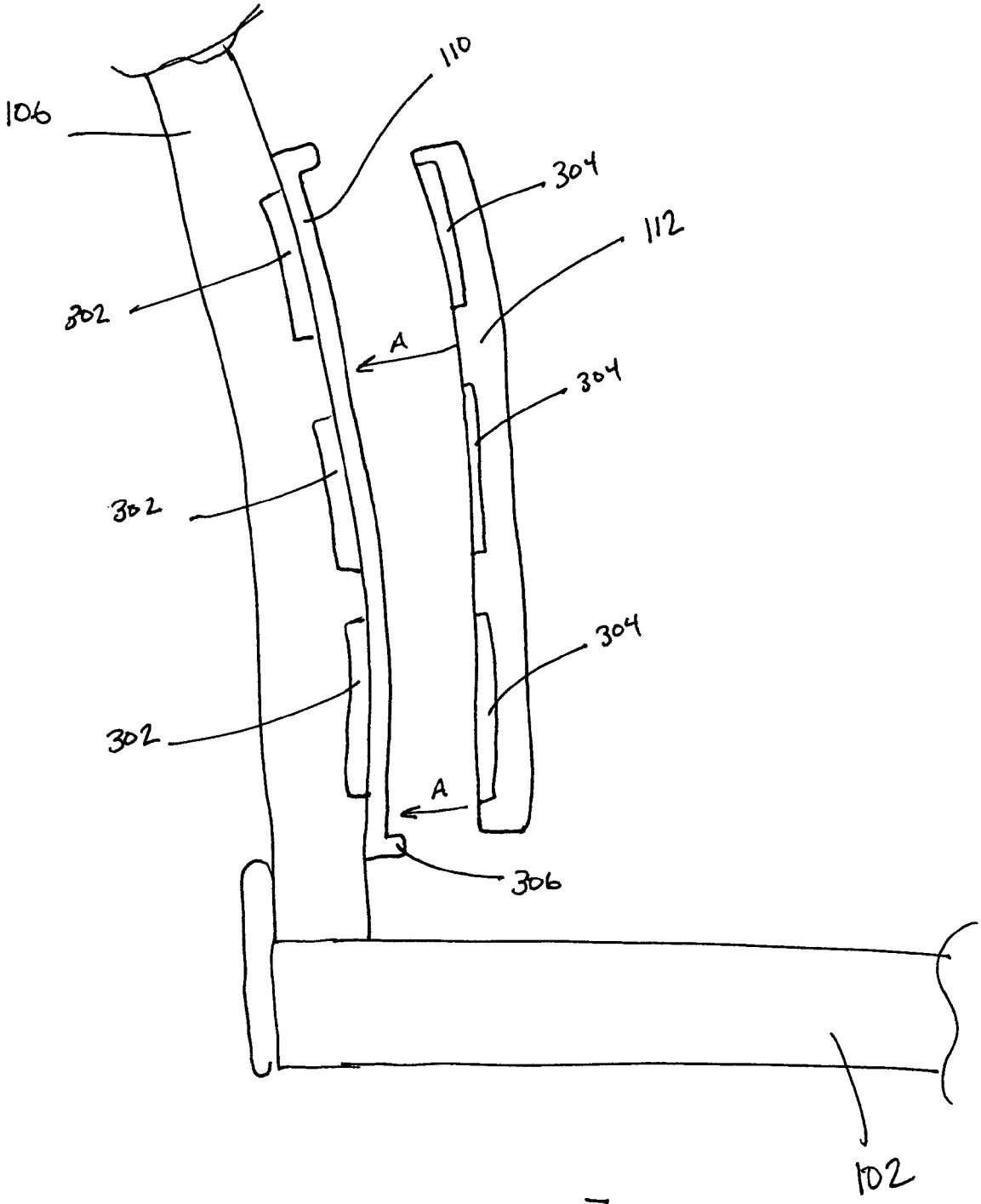
FIG. 3 illustrates a close up sectional view of an exemplary magnetic advertising media location of the invention.

FIG. 3 illustrates a more detailed sectional view of an exemplary magnetically attachable advertising media location 110 of the invention. In this embodiment of the invention, the advertising logo 112 is secured to the advertising media location 110 via a magnetic securing force. More particularly, in this embodiment of the invention, the advertising media location 110 includes magnetic material 302 incorporated therein. The magnetic material 302 may be a small amount of ferrous material that is attractable to a magnet, or alternatively, the magnetic material 302 may actually be a magnet. Similarly, the advertising logo 112 also includes magnetic material 304 incorporated therein. In similar fashion to the magnetic material 302 positioned in the advertising media location 110, the magnetic material 304 positioned in the logo 112 may a small amount of ferrous material that is attractable to a magnet, or alternatively, the magnetic material 302 may be a magnet. The combination of the magnetic material and/or ferrous material generates an attractive force that pulls the logo 112 toward the advertising media location 110 in the direction of arrow "A". Thus, when the user desires to remove or interchange the logo 112 with a different logo 112, a removal force must be applied to the logo 112 in a direction opposite of arrow "A". The removal force must be greater in magnitude than the attractive generated by the magnetic material and/or ferrous material so that the logo 112 may be dislodged from the advertising media location. The logo 112 is maintained in a centered or desired position by a centering member 306. The centering member 306 may comprise a protruding ridge that surrounds or at least partially surrounds the perimeter of the advertising media location 110 in a manner that centers or positions the logo 112 in a desired position within the advertising media location 110.

In embodiments of the invention where both magnetic material 302 and 304 are magnets, the magnetic material 302 positioned in the hat 100 may have a negative polarity, for example. Accordingly, the magnetic material 304 positioned in the advertising logo 112 may have a positive polarity, for example. The opposing or opposite polarities of the magnetic materials 302, 304 operates to cause the logo 112 and the advertising media location to have a magnetic attractive force between them. This magnetic attractive force is calculated to secure and maintain the logo 112 in the advertising media location 110 while the hat 100 is being worn by the user, i.e., the size and strength of the respective magnetic materials 302, 304 is configured to hold the logo 112 in the advertising media location without adding substantial weight to the hat 100.

In embodiments of the invention where one of magnetic materials 302, 304 is a ferrous material, then one of the other one of the magnetic materials 302, 304 will generally be a magnet, so that the respective magnetic materials 302, 304 are attracted to each other. In similar fashion to other embodiments, the size and configuration of the ferrous material and the magnet in this embodiment of the invention are configured to provide an attractive force sufficient to secure the logo 112 to the advertising media location 110 without adding substantial additional weight to the hat 100.

In another embodiment of the invention, the magnetic materials 302, 304 are replaced with a hook and loop-type fastening system, such as a Velcro® material, for example. The Velcro® material may be positioned on an outward facing surface of the advertising media location 110 and on an inwardly facing surface of the logo 112. The respective Velcro® materials are positioned so that when the logo 112 is positioned in the advertising media location 110, the respective Velcro® materials engage each other and secure the logo 112 to the advertising media location 110. Similarly, the logo 112 may be removed from the advertising media location 110 by simply pulling the logo 112 to disengage the respective Velcro® portions from each other. The removal of the logo 112 may generally be conducted in less than about 2 seconds, for example.

In another embodiment of the invention, the magnetic materials 302, 304 are replaced with a type of double sided tape material. The double sided tape material may be positioned on an outward facing surface of the advertising media location 110 and/or on an inwardly facing surface of the logo 112. The respective double sided tape materials are positioned so that when the logo 112 is positioned in the advertising media location 110, the respective double sided tape materials engage each other and secure the logo 112 to the advertising media location 110 (or if one double sided tape material is used, then the single tape material engages the opposing member). Similarly, the logo 112 may be removed from the advertising media location 110 by simply pulling the logo 112 to disengage the respective double sided tape portions from each other. The removal process of the logo 112 may be conducted in less than about 2 seconds, for example.

Although embodiments of the invention illustrate the logo 112 being positioned on the front side of the hat 100, embodiments of the invention are not intended to be limited to any particular positioning of the advertising media location 110 or the logo 112. The inventors contemplate that the logo and/or advertising media location may be positioned on any surface of the hat 100, including the top, sides, back, brim top, brim bottom, etc. of the hat 100. Preferably the logo 112 is positioned on a surface of the hat 100 that is visible to those around the wearer of the hat 100 so that the visibility (advertising value) of the hat 100 having the logo 112 thereon is maximized.

Regardless of the particular configuration of the hat of the present invention, i.e., whether the hat uses magnetic material, ferrous material, hook and loop fasteners, double sided tape, or another fastening means to secure the logo 112 to the advertising media location 110, the crux of the present invention is that a hat is provided where the logos on the hat may be interchanged in just a few seconds without complication. This interchangeability provides great flexibility for advertisers in that they can swap advertising logos out in seconds, and further, the interchangeability reduces advertising costs in that advertisers can use one hat to display in infinite number of logos. Additionally, the invention provides for replacement of an advertising logo on the hat in less than about 2 seconds and with no special tools. The ease of interchangeability will save valuable time and increase profitability in the advertising business.

While the foregoing is directed to embodiments of the present invention, other and further embodiments of the invention may be devised without departing from the basic scope thereof, where the scope thereof is determined by the claims that follow.

The invention claimed is:

1. A hat configured to accept interchangeable advertising media, comprising:

a hat body;

an advertising media receiving location positioned on the hat body;

a logo sized to be received in the advertising media location;

at least one centering member positioned around the receiving location, the at least one centering member comprising a protruding member that extends outward from the receiving location and is positioned to engage an edge of the logo when the logo is positioned in the receiving location; and means for releasably securing the logo to the advertising media location, wherein the means for releasably securing the logo to the advertising media location further comprises magnetic material positioned in at least one of the advertising media location and the logo.

2. The hat of claim 1, wherein the logo further comprises a magnet and the advertising media location comprises a ferrous material.

3. The hat of claim 1, wherein the logo further comprises a first magnet having a first polarity, and the advertising media location comprises a second magnet having a second polarity, wherein the first polarity is different from the second polarity.

4. The hat of claim 1, wherein the means for releasably securing the logo to the advertising media location further comprises a hook and loop fastening system.

5. The hat of claim 1, wherein the means for releasably securing the logo to the advertising media location further comprises a double sided tape material.

6. The hat of claim 1, wherein the advertising media location is positioned on the hat body above a brim of the hat.

7. The hat of claim 1, wherein the centering member comprises a protruding member that at least partially surrounds the advertising media location.

8. A wearable headgear having a removable advertising logo positioned thereon, comprising:

a receiving element for an advertising logo;

at least two centering members positioned near a perimeter of the receiving element, the at least two centering members comprising elongated guide members that extend outward from the receiving element that are configured to simultaneously engage an edge of the advertising logo to center the logo in the receiving element;

first securing material positioned in the receiving element; and second securing material positioned in the logo, wherein the first and second securing materials generate an attractive force between them sufficient to hold the advertising logo in the receiving element.

9. The wearable headgear of claim 8, wherein the attractive force comprises a force sufficient to hold the advertising logo in the receiving element while allowing for the advertising logo to be removed from the receiving element upon application of a removal force.

10. The wearable headgear of claim 9, wherein the first securing material in the receiving element comprises a first magnet having a first polarity and the second securing material in the logo comprises a second magnet having a second polarity, the first polarity being opposite from the second polarity.

11. The wearable headgear of claim 9, wherein the first and second securing materials comprise a tape material.

12. The wearable headgear of claim 10, wherein advertising logo is configured to be removed from the receiving element in less than about 2 seconds.

13. A wearable hat, comprising:

a hat body configured to receive a head of a wearer;

a brim attached to the hat body and extending therefrom, the brim being positioned on the body at a position above the face of the wearer;

an advertising media location positioned on the hat body;

a plurality of elongated logo centering guide members extending outward from the advertising media location, the plurality of logo centering guide members being configured to engage an edge of a logo positioned in the advertising media location to center the logo therein;

a releasable advertising logo positioned in the advertising media location;

a first magnetic material positioned in the advertising media location; and a second magnetic material positioned in the advertising logo, the first and second magnetic material generating an attractive force therebetween.

* * * * *